US006570076B1

(12) United States Patent
Kjellgren

(10) Patent No.: US 6,570,076 B1
(45) Date of Patent: May 27, 2003

(54) ADJUSTABLE DRUM PEDAL AND METHOD THEREFOR

(76) Inventor: Goran Kjellgren, 662 Kwa Ovi, Flagstaff, AZ (US) 86001

( * ) Notice: Subject to any disclaimer, the term of this patent is extended or adjusted under 35 U.S.C. 154(b) by 0 days.

(21) Appl. No.: 09/992,868

(22) Filed: Nov. 16, 2001

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS

| | | | | |
|---|---|---|---|---|
| 833,706 | A | | 10/1906 | Conn |
| 3,439,574 | A | | 4/1969 | Ramsey |
| 3,930,431 | A | | 1/1976 | Magadini |
| 4,134,325 | A | | 1/1979 | Loftus |
| 4,691,613 | A | | 9/1987 | Jacobson |
| 4,873,910 | A | | 10/1989 | Kurosaki |
| 5,458,038 | A | | 10/1995 | Kurosaki |
| 5,591,929 | A | | 1/1997 | Wellman |
| 5,866,830 | A | | 2/1999 | Onyszkanycz |
| 6,011,208 | A | * | 1/2000 | Hoshino ..... 84/422.1 |
| 6,075,191 | A | | 6/2000 | Scire |
| 6,150,596 | A | | 11/2000 | Hsieh |
| 6,259,012 | B1 | | 7/2001 | Hoshino |
| 2001/0002571 | A1 | | 6/2001 | Tanaka |

* cited by examiner

*Primary Examiner*—Kim Lockett
(74) *Attorney, Agent, or Firm*—Jeffrey D. Moy; Harry M. Weiss; Weiss, Moy & Harris, P.C.

(57) ABSTRACT

An drum pedal which allows one to adjust the position and/or angel of the pedal in order to have better control and comfort when using the drum pedal. The adjustable drum pedal has a base plate. A foot pedal is movably coupled to the base plate wherein the foot pedal is able to move vertically along a width of the base plate and is able to rotate about a pivot point. A frame is also coupled to the base plate. A drum beater mechanism is removably coupled to the frame. This will allow one to adjust a position of the drum beater mechanism on the frame. A drive assembly is coupled to the drum beater mechanism and the foot pedal. The drive assembly is used for moving the drum beater mechanism when pressure is applied to the foot pedal and for returning the drum beater mechanism to a starting position when the pressure is removed from the foot pedal.

19 Claims, 2 Drawing Sheets

ADJUSTABLE DRUM PEDAL AND METHOD THEREFOR

BACKGROUND OF THE INVENTION

1. Field of the Invention

This invention relates generally to musical instruments, and more specifically, to an adjustable drum pedal which allows the user to adjust the position and/or angel of the pedal in order to have better control and comfort when using the drum pedal.

2. Background of the Invention

In order to operate a bass drum, a pedal mechanisms is generally provided which includes a depressible foot pedal. When the foot pedal is depressed, a means is activated which causes a beater ball to move through an arc and strike the bass drum. When pressure is removed from the pedal and the pedal is released, the beater ball will return to a resting position ready to move forward again to strike the drum when pressure is again applied to the foot pedal and depressed again.

It is a well known that the feet of different people are different in both size and shape. Furthermore, many people have alignment problems with their feet such as being pigeon toed or duck footed. Other individuals have feet which may be diseased or have a muscle control problem. However, present conventional bass drum pedal are not adjustable in order to compensate for the above mentioned problems. Present bass drum pedals have no mechanism in which to allow the operator to adjust the position of the foot pedal in different directions in a quick and efficient manner as well as to adjust the position of the beater ball.

Therefore, a need existed to provide an adjustable drum pedal that overcomes the above mentioned problem. The adjustable drum pedal will allow the operator to adjust the position of the foot pedal in different directions in a quick and efficient manner. The adjustable drum pedal will further allow the operator to adjust the position of the beater ball.

SUMMARY OF THE INVENTION

In accordance with one embodiment of the present invention, it is an object of the present invention to provide an adjustable drum pedal.

It is another object of the present invention to provide an adjustable drum pedal that will allow the operator to adjust the position of the foot pedal in different directions in a quick and efficient manner.

It is still another object of the present invention to provide an adjustable drum pedal that will allow the operator to adjust the position of the foot pedal in different directions in a quick and efficient manner as well as to adjust the position of the beater ball.

BRIEF DESCRIPTION OF THE PREFERRED EMBODIMENTS

In accordance with one embodiment of the present invention, an adjustable drum pedal is disclosed. The adjustable drum pedal has a base plate. A foot pedal is movably coupled to the base plate wherein the foot pedal is able to move along a width of the base plate and is able to rotate about a pivot point. A frame is also coupled to the base plate. A drum beater mechanism is removably coupled to the frame. This will allow one to adjust a position of the drum beater mechanism on the frame. A drive assembly is coupled to the drum beater mechanism and the foot pedal. The drive assembly is used for moving the drum beater mechanism when pressure is applied to the foot pedal and for returning the drum beater mechanism to a starting position when pressure is removed from the foot pedal.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiment when read in conjunction with the accompanying drawings, wherein like reference numerals and symbols represent like elements.

DETAILED DESCRIPTION

Figure 3:
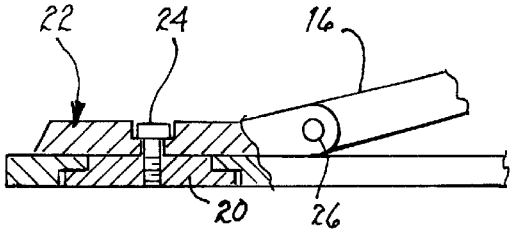
FIG. 3 is a cross sectional side view of the adjustable drum pedal of the present invention taken along lines 3—3 of FIG. 3.

Referring now to the FIG. 1, an adjustable drum pedal 10 (hereinafter drum pedal 10) is shown. The drum pedal 10 has a base plate 12. The base plate 12 has a first slot 14 located along a bottom section of the base plate 12. The slot 14 runs along the majority of the width of the base plate 12. A foot pedal 16 is movably coupled to the base plate 12 within the first slot 14. A coupling mechanism 18 is used to movably coupled the foot pedal 16 to the base plate 12 and to allow the foot pedal 16 to pivot in a vertical manner.

Figure 2:
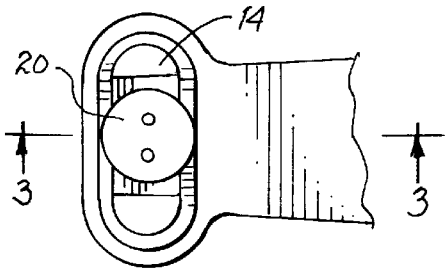
FIG. 2 is a partial bottom view of the rear section of the base plate used in the adjustable drum pedal of the present invention.

Referring now to FIG. 2 wherein like numerals and symbols represent like elements, a magnified view of the coupling mechanism 18 is shown. The coupling mechanism 18 has a tab member 20. The tab member 20 is of a size to secure the foot pedal 16 within the first slot 14. The tab member 20 will allow the foot pedal 16 to slide within the first slot 14. The tab member 20 will further allow the foot pedal 16 to rotate about the tab member. Thus, the tab member 20 will allow the operator of the drum pedal 10 to quickly and easily adjust the position of the foot pedal 16 relative to the base plate 12. The operator will then be able to comfortably place his/her foot completely on the foot pedal 16 no matter what size, shape or alignment problem he/she may have.

The coupling mechanism 18 further has a hinged member 22. In the embodiment depicted in FIG. 3, the hinged member 22 is coupled to the tab member 20. However, it should be noted that the tab member 20 and the hinged member 22 may be formed of a single piece. In the present embodiment, the hinged member 22 is coupled to the tab member 20 via one or mode connectors 24. The foot pedal 16 is coupled to the hinged member 22 by a pin 26. The pin 26 allows the foot pedal 16 to pivot about the hinged member 22.

Figure 4:
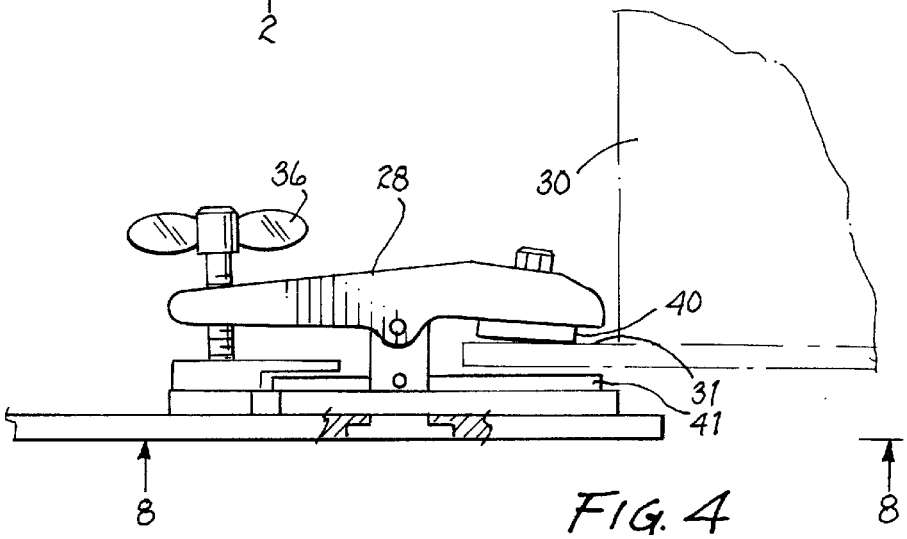
FIG. 4 is a side view of the adjustable drum clamp used in the adjustable drum pedal of the present invention.
Figure 10:
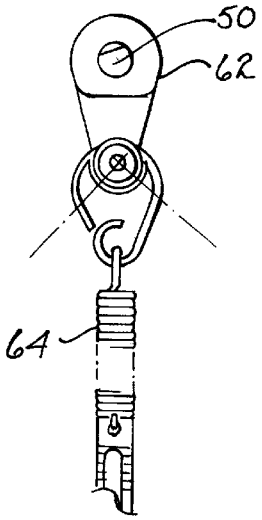
FIG. 10 is a cross section view of the spring mechanism used in the adjustable drum pedal of the present invention taken along lines 10—10 of FIG. 5.
Figure 6:
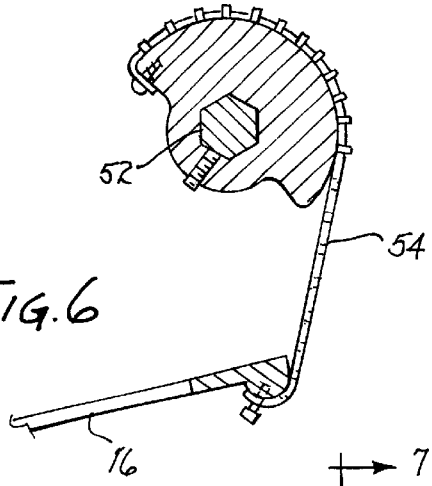
FIG. 6 is a cross sectional side view of the cam mechanism used in the adjustable drum pedal of the present invention taken along lines 6—6 of FIG. 5.

Referring now to FIG. 4 wherein like numerals and symbols represent like elements, a clamping device 28 is shown. The clamping device 28 is used to attach the drum pedal 10 to a rim of a bass drum 30. What is unique about the clamping device 28 is that the clamping device 28 is adjustable. The clamping device 28 will allow the operator to adjust the position of the drum pedal 10 in relation to the bass drum 30.

Figure 8:
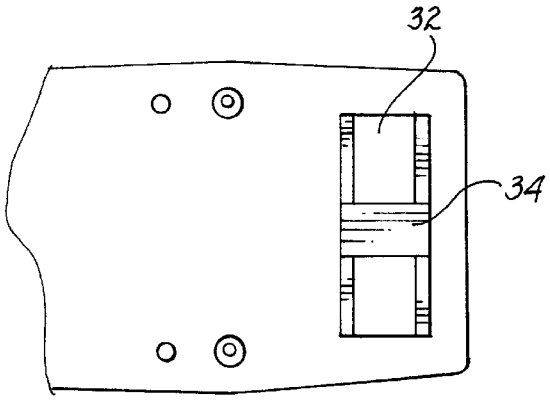
FIG. 8 is a partial bottom view of the top section of the base plate used in the adjustable drum pedal of the present invention.

The base plate 12 has a second slot 32 (See also FIG. 8). The second slot 32 is located on a top section of the base plate 12. The second slot runs a majority of the width of the base plate 12. The clamping device 28 is designed so that the clamping device 28 is allowed to slide within the second slot 32 in order to adjust the position of the clamping device 28. The clamping device 28 will have a tab member 34. The tab member 34 is of a sufficient size to secure the clamping device 28 within the second slot 32 but still allow the clamping device 28 to slide within the second slot 32.

The clamping device 28 has an adjustment device 36. The adjustment device 36 is used to lock the clamping device 28 in position. By loosening the adjustment device 36, the operator may slide the clamping device 28 within the second slot 32 in order to adjust the position of the clamping device 28. When the operator has selected the proper position for the base pedal 10, the operator will tighten adjustment device 36 to lock the clamping device 28 in position. By tightening the clamping device 28, the operator will further secure the foot pedal 10 to the rim 31 of the bass drum 30. By tightening the adjustment device 36, a pair skid resistant pads 40 will contract around the rim 31 of the bass drum 30 securing the foot pedal 10 to the bass drum 30. The clamping device 28 has a follower rod 41. The follower rod 41 will help in locking the clamping device 28 to the bottom of the rim 31 of the bass drum 30. The follower rod 41 will have a skid resistant pad 40 to aid in securing the foot pedal 10 to the bass drum 30.

Figure 1:
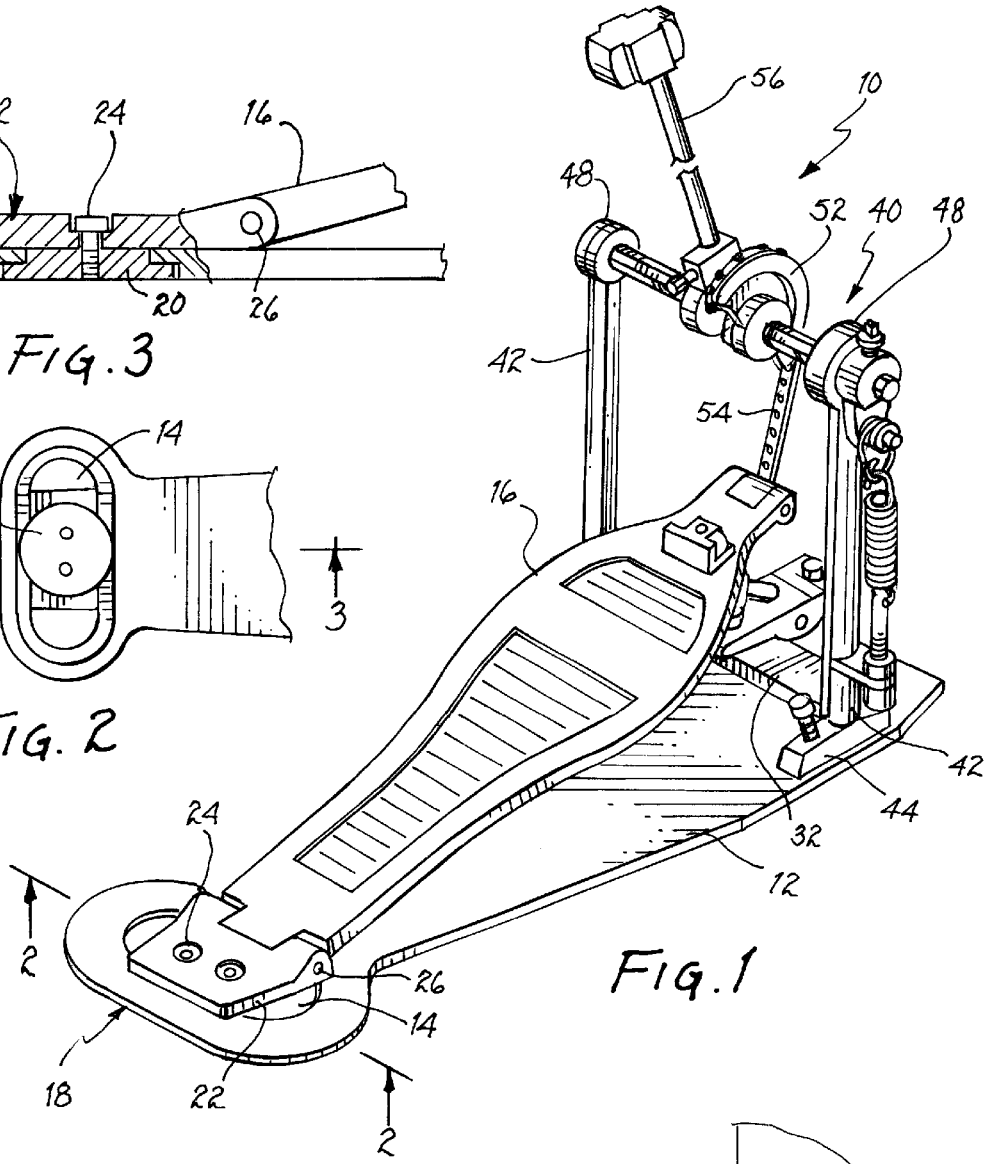
FIG. 1 is an elevated perspective view of the adjustable drum pedal of the present invention.
Figure 5:
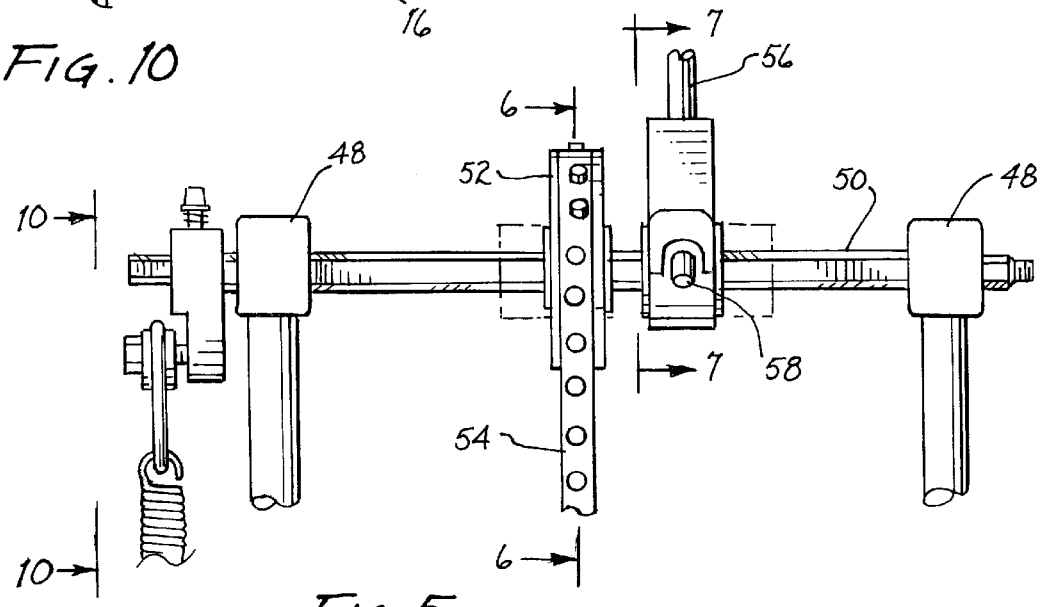
FIG. 5 is a partial front view of the cam and beater mechanism of the adjustable drum pedal of the present invention.
Figure 9:
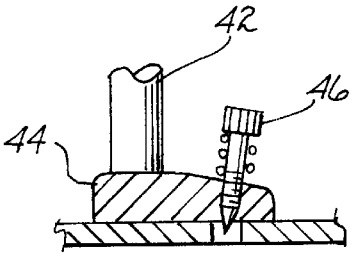
FIG. 9 is a cross sectional side view of the support bars used in the adjustable drum pedal of the present invention.

Referring now to FIGS. 1 and 5, a beater support bar 40 is coupled to the base plate 12. The beater support bar 40 is comprised of a pair of vertical bar members 42. As seen more clearly in FIG. 9, one end of each vertical bar member 42 is coupled to a base member 44. The base member 44 is coupled to the base plate 12 via a coupling device 46. The coupling device 46 may be a screw, peg, rivet, or similar item. It should be noted that the above listing should not be seen as to limit the scope of the present invention.

On the other end of each vertical bar members 42 is a loop member 48. A crossbar 50 is inserted into each of the loop members 48. The crossbar 50 is allowed to rotate within the loop members 48 when a torque is applied to the crossbar 50. A wheel mechanism 52 is coupled to the crossbar 50. The wheel mechanism 52 is further coupled to the foot pedal 16 via a belt 54. The belt 54 may be a metal chain, a rubber belt or like element. It should be noted that the listing of the above examples should not be seen as to limit the scope of the present invention. When pressure is applied to the foot pedal 16, the belt 54 (via the wheel mechanism 52) will cause the crossbar 50 to rotate. This will cause a drum beater 56, which is also coupled to the crossbar 50, to strike the bass drum 30.

Figure 7:
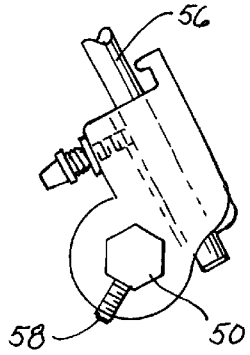
FIG. 7 is a cross sectional side view of the beater mechanism used in the adjustable drum pedal of the present invention taken along lines 7—7 of FIG. 5.

Referring now specifically to FIG. 7, as stated above, the drum beater 56 is also coupled to the crossbar 50. What is unique about the drum beater 56 is that the drum beater 56 is removably coupled to the cross bar 50. The drum beater 56 has a release mechanism 58. The release mechanism 58 will allow the drum beater 56 to be placed at any position on the crossbar 50. This will allow the drum beater 56 to always be striking the center of the bass drum 30 no matter the position of the drum pedal 10. Furthermore, by moving the drum beater 56, one may increase the adjustability of the drum pedal 10. This is due to the fact that moving the drum beater 56 will allow the foot pedal 16 to move and pivot to a greater degree.

Referring now to FIGS. 1, 5, and 7, a spring device 60 is coupled to the crossbar 50. The spring device 6O has a cam 62. The cam 62 is coupled to the crossbar 50. One end of a spring 64 is coupled to the cam 62. The other end of the spring 64 is coupled to the base plate 12 or the base member 44. When pressure is applied to the foot pedal 16, the crossbar 50 will rotate causing the drum beater 56 to strike the bass drum. When pressure is removed from the foot pedal 16, the spring device 60 will bring the crossbar 50 back to its original position drawing the drum beater 50 back away from the bass drum 30.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An adjustable drum pedal comprising, in combination:

a base plate;

a foot pedal movably coupled to the base plate wherein the foot pedal is able to move along a width of the base plate and is able to rotate about a pivot point;

a drum beater mechanism removably coupled to the frame to allow one to adjust a position of the drum beater mechanism on the frame;

a drive assembly coupled to the drum beater mechanism and the foot pedal for moving the drum beater mechanism when pressure is applied to the foot pedal and for returning the drum beater mechanism to a starting position when pressure is removed from the foot pedal; and a clamping device movably coupled to the base plate for allowing one to couple the adjustable drum pedal in multiple positions relative to a drum.

2. An adjustable drum pedal in accordance with claim 1 further comprising:

a first slot running along a width of a bottom section of the base plate; and an adjustment mechanism position in the first slot and coupled to the foot pedal for allowing the foot pedal to move within the first slot and to pivot about the pivot point.

3. An adjustable drum pedal in accordance with claim 2 wherein the adjustment mechanism comprises:

an adjustment mechanism tab positioned in the first slot and which runs within the first slot allowing the foot pedal which allows the foot pedal to move within the first slot and to pivot about the adjustment mechanism tab; and a hinged member coupled to the adjustment mechanism tab and the foot pedal for allowing the foot pedal to pivot in an up and down motion.

4. An adjustable drum pedal in accordance with claim 1 further comprising:

a second slot running along a width of a top section of the base plate; and a clamping device adjustment mechanism position in the second slot and coupled to the clamping device for allowing the clamping device to move within the second slot.

5. An adjustable drum pedal in accordance with claim 1 wherein the frame comprises:

a pair of support bars;

base members coupled to the base plate and the pair of support bars for coupling the support bars to the base plat; and a cross bar rotatably coupled to the support bars.

6. An adjustable drum pedal in accordance with claim 1 wherein the drive assembly comprises:

a wheel device coupled to the frame; and a belt coupled to the wheel device and to the foot pedal.

7. An adjustable drum pedal in accordance with claim 6 wherein the drive assembly further comprises a spring device coupled to the frame for bring back the drum beater mechanism to a starting position when pressure is removed from the foot pedal.

8. An adjustable drum pedal comprising, in combination:

a base plate;

a foot pedal movably coupled to the base plate wherein the foot pedal is able to move vertically along a width of the base plate and is able to rotate about a pivot point;

a frame;

a drum beater mechanism removably coupled to the frame to allow one to adjust a position of the drum beater mechanism on the frame;

a drive assembly coupled to the drum beater mechanism and the foot pedal for moving the drum beater mechanism when pressure is applied to the foot pedal and for returning the drum beater mechanism to a starting position when the pressure is removed from the foot pedal;

a clamping device movably coupled to the base plate for coupling the adjustable drum pedal to a drum;

a first slot running along a width of a bottom section of the base plate;

an adjustment mechanism position in the first slot and coupled to the foot pedal for allowing the foot pedal to move within the first slot and to pivot about the pivot point;

a second slot running along a width of a top section of the base plate; and a clamping device adjustment mechanism position in the second slot and coupled to the clamping device for allowing the clamping device to move within the second slot.

9. An adjustable drum pedal in accordance with claim 8 wherein the adjustment mechanism comprises:

an adjustment mechanism tab positioned in the first slot and which runs within the first slot allowing the foot pedal which allows the foot pedal to move within the first slot and to pivot about the adjustment mechanism tab; and a hinged member coupled to the adjustment mechanism tab and the foot pedal for allowing the foot pedal to pivot in an up and down motion.

10. An adjustable drum pedal in accordance with claim 8 wherein the frame comprises:

a pair of support bars;

base members coupled to the base plate and the pair of support bars for coupling the support bars to the base plat; and a cross bar rotatably coupled to the support bars.

11. An adjustable drum pedal in accordance with claim 8 wherein the drive assembly comprises:

a wheel device coupled to the frame; and a belt coupled to the wheel device and to the foot pedal.

12. An adjustable drum pedal in accordance with claim 11 wherein the drive assembly further comprises a spring device coupled to the frame for bring back the drum beater mechanism to a starting position when pressure is removed from the foot pedal.

13. An adjustable drum pedal comprising, in combination:

a base plate;

a foot pedal movably coupled to the base plate wherein the foot pedal is able to move vertically along a width of the base plate and is able to rotate about a pivot point;

a frame;

a drum beater mechanism removably coupled to the frame to allow one to adjust a position of the drum beater mechanism on the frame;

a drive assembly coupled to the drum beater mechanism and the foot pedal for moving the drum beater mechanism when pressure is applied to the foot pedal and for returning the drum beater mechanism to a starting position when the pressure is removed from the foot pedal; and a clamping device movably coupled to the base plate for coupling the adjustable drum pedal to a drum.

14. An adjustable drum pedal in accordance with claim 13 further comprising:

a first slot running along a width of a bottom section of the base plate; and an adjustment mechanism position in the first slot and coupled to the foot pedal for allowing the foot pedal to move within the first slot and to pivot about the pivot point.

15. An adjustable drum pedal in accordance with claim 14 wherein the adjustment mechanism comprises:

an adjustment mechanism tab positioned in the first slot and which runs within the first slot allowing the foot pedal which allows the foot pedal to move within the first slot and to pivot about the adjustment mechanism tab; and a hinged member coupled to the adjustment mechanism tab and the foot pedal for allowing the foot pedal to pivot in an up and down motion.

16. An adjustable drum pedal in accordance with claim 14 further comprising:

a second slot running along a width of a top section of the base plate; and a clamping device adjustment mechanism position in the second slot and coupled to the clamping device for allowing the clamping device to move within the second slot.

17. An adjustable drum pedal in accordance with claim 15 wherein the frame comprises:

a pair of support bars;

base members coupled to the base plate and the pair of support bars for coupling the support bars to the base plat; and a cross bar rotatably coupled to the support bars.

18. An adjustable drum pedal in accordance with claim 13 wherein the drive assembly comprises:

a wheel device coupled to the frame; and a belt coupled to the wheel device and to the foot pedal.

19. An adjustable drum pedal in accordance with claim 18 wherein the drive assembly further comprises a spring device coupled to the frame for bring back the drum beater mechanism to a starting position when pressure is removed from the foot pedal.

* * * * *